United States Patent [19]

Braginetz et al.

[11] 4,213,666

[45] Jul. 22, 1980

[54] MECHANISM FOR POSITIONING A TEST ADAPTER IN OPERATIVE RELATIONSHIP WITH A RECEIVER

[75] Inventors: Paul A. Braginetz, Staunton; Paul D. Floyd, Lyndhurst, both of Va.

[73] Assignee: Virginia Panel Corporation, Waynesboro, Va.

[21] Appl. No.: 6,572

[22] Filed: Jan. 26, 1979

[51] Int. Cl.[3] ..... G05G 9/00; H01R 13/62

[52] U.S. Cl. ..... 339/75 M; 74/491; 339/45 M

[58] Field of Search ..... 74/96, 99, 105, 106, 74/491, 512; 100/282; 269/196, 198, 200, 231, 232; 339/75 R, 75 M, 65 R, 65 M, 18 R, 18 B; 200/153 L, 329

[56] References Cited

U.S. PATENT DOCUMENTS

| | | | |
|---|---|---|---|
| 2,944,864 | 7/1960 | Krivulica | 339/75 M |
| 3,315,212 | 4/1967 | Peterson | 339/75 M |
| 3,501,735 | 3/1970 | Bauman et al. | 339/75 M |
| 4,045,109 | 8/1977 | Langenbach et al. | 339/75 M |

FOREIGN PATENT DOCUMENTS

| | | | |
|---|---|---|---|
| 625388 | 6/1949 | United Kingdom | 339/75 M |

*Primary Examiner*—Roy Lake
*Assistant Examiner*—Eugene F. Desmond
*Attorney, Agent, or Firm*—B. P. Fishburne, Jr.

[57] ABSTRACT

A mechanism to reduce the physical effort and arm movement of an operator in positioning the multiple electrical contacts of a test adapter and receiver in engaged relationship with the receiver located in a support well of a table and the operator seated at the table. The mechanism includes a short stroke low effort hand lever depending from the table in ready reach of the operator, the hand lever forming one component of a compactly stacked motion and force reducing linkage held in a recess in one side frame member of the receiver and operatively connected with a rotational cam shaft on the receiver which cams the test adapter into operative engagement with the receiver by overriding accumulated forces created by the deflection of the multiple contacts.

6 Claims, 17 Drawing Figures

FIG. 6
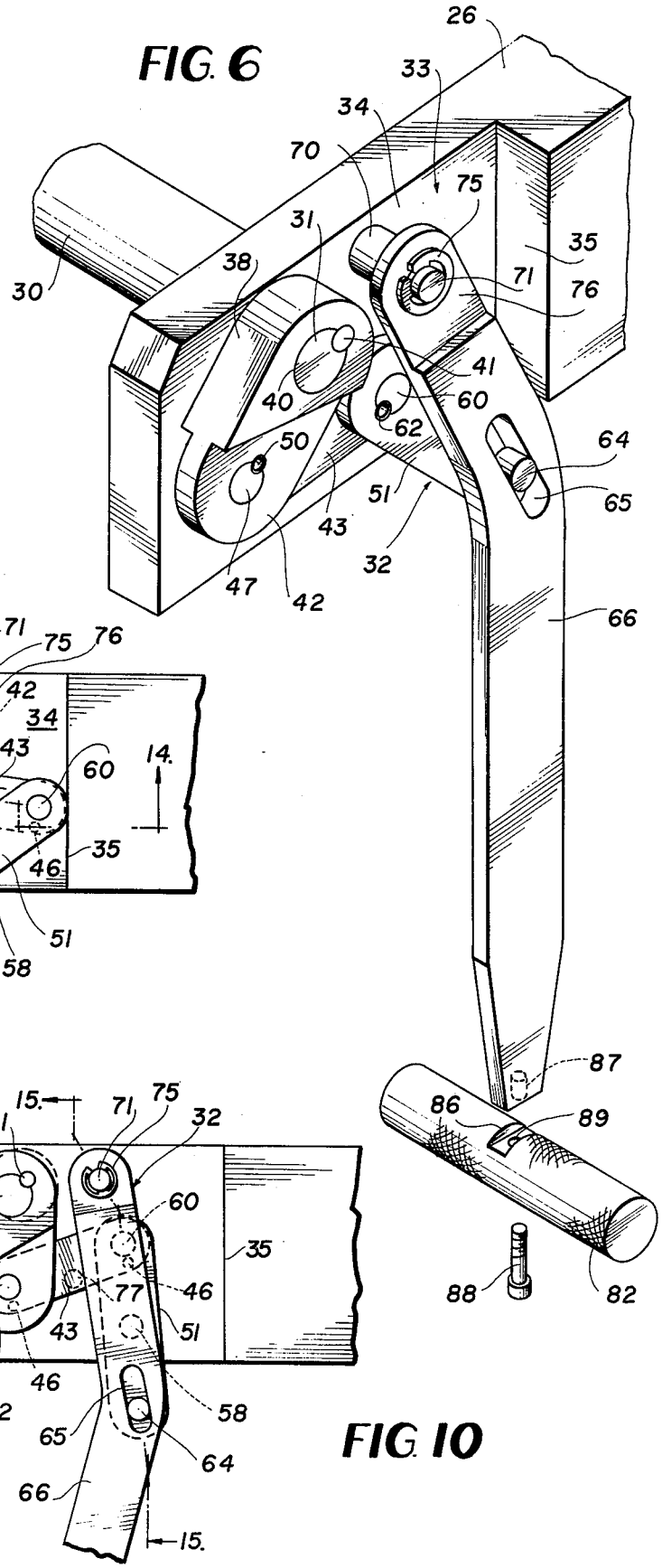
FIG. 8
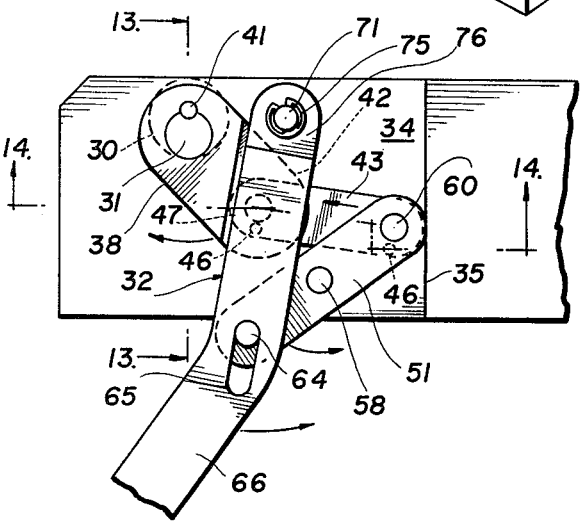
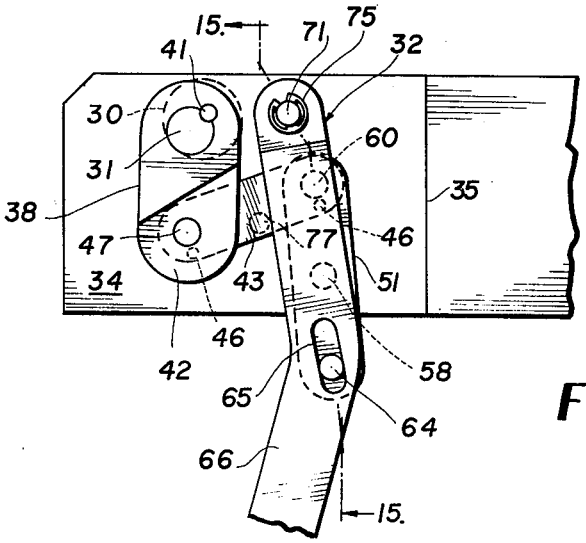
FIG. 10

MECHANISM FOR POSITIONING A TEST ADAPTER IN OPERATIVE RELATIONSHIP WITH A RECEIVER

BACKGROUND OF THE INVENTION

Certain test apparatus associated with computer interface equipment requires the positioning of individual test adapters into receivers with multiple contacts of the test adapter operatively engaged in current carrying relationship with coacting contacts of the receiver. The receiver may accept one or more individual test adapters. The present invention embraces a receiver cam actuating mechanism of high efficiency, compactness and convenience of operation for imparting a required movement to a roll cam bar which moves against the concave surface of a juxtaposed individual test adapter to override accumulated forces created by the deflection of flexible contacts resisting engagement with test adapter contacts.

Since pairs of such contacts resist engagement by a force in the range of 6 ozs. to 8 ozs., and the test adapter and receiver have as many as 6000 pairs of coacting contacts, it is possible to encounter a total resistive force of 3000 pounds, more or less, which must be overridden by the action of the receiver roll cam bar. The individual test adapter normally nests ball detent type contacts and the receiver nests yielding paddle type contacts. It is the individual test adapter which comprises the moving component actuated by the receiver roll cam bar, and wherein the ball detent contacts are fixed post elements which cause deflection of the receiver paddle contacts as engagement takes place.

Individual test adapters of the type involved in this invention are placed within and removed from receivers for interchange of programming using other individual test adapters or for repair. The receiver is installed in a recess or well in a table top of desk design. Operators working on these units are usually women seated at the provided table and it becomes important that they are able to interchange the individual test adapters with relative ease, convenience and efficiency. To achieve these ends, it is imperative that the receiver roll cam bar be able to override opposing forces after a minimum amount of movement of the mechanism hand lever which extends below the table top in ready reach of the operator and with minimum effort on the part of the operator. The roll cam bar driving or operating mechanism forming the heart of this invention completely accomplishes these stated requirements in a simple and comparatively economical manner as will be fully described hereinafter.

The mechanism includes a number of stacked components which in assembled relationship are snugly received in a recess provided in one frame side of the receiver, whereby the presence of the mechanism does not increase the overall dimensions of the receiver frame. The mechanism is rugged and durable and its stacked interconnected linkage components are self-retaining in the assembly and are captured between a single retainer ring and an opposing wall of the mounting recess provided in the receiver side rail or frame member. Among the important advantages of the invention are the following:

(1) Hand lever movement of less than 6 inches produces roll cam bar rotation for a full 90 degrees.

(2) The mechanism is positively stopped in both the closed and open positions by abutment with a wall of the receiver frame mounting recess to prevent mechanism "override" in either position.

(3) The hand lever is located outwardly of the receiver and at the outside of the stacked linkage where a single E-ring is employed to maintain the mechanism assembled with the receiver and roll cam bar.

(4) The mechanism is nested inside of the receiver frame margin and therefore does not increase the size of the receiver.

Other features and advantages of the invention will become apparent during the course of the following description.

The following known prior art United States patents of general interest only relative to the invention are made of record under 37 C.F.R. 1.56:

8,597 304,048
63,945 705,701
164,212 2,612,058
191,087 2,782,666

BRIEF DESCRIPTION OF THE DRAWINGS

FIG. 6 is a fragmentary perspective view of the roll cam bar operating mechanism assembled on the receiver.

FIG. 8 is a fragmentary side elevation of the mechanism in the open or release position.

FIG. 10 is a view similar to FIG. 8 showing the mechanism in an intermediate position.

DETAILED DESCRIPTION

Figure 1:
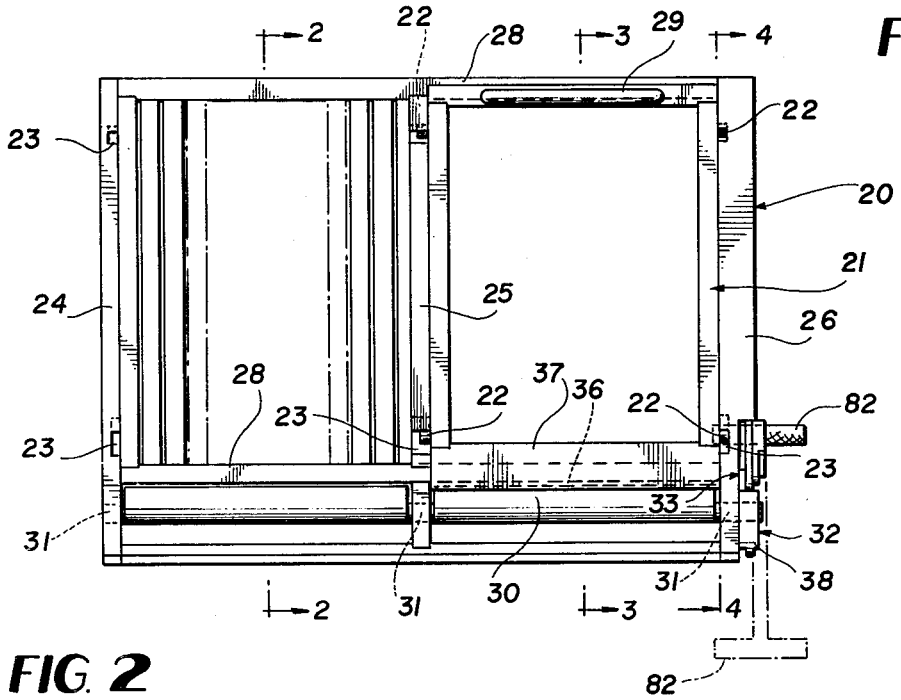
FIG. 1 is a plan view of a typical receiver and individual test adapter mounted thereon with the multiple contacts of the two units engaged by operation of the mechanism embodying the invention.
Figure 2:
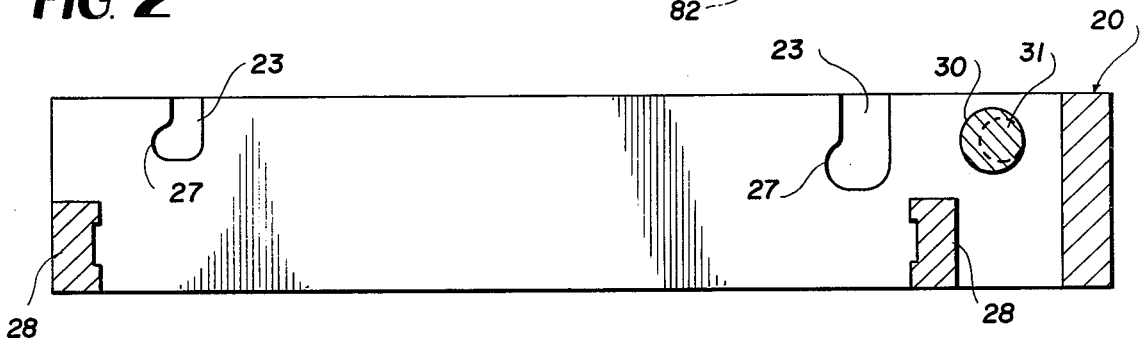
FIG. 2 is an enlarged vertical section taken on line 2—2 of FIG. 1.

Referring to the drawings in detail wherein like numerals designate like parts, FIGS. 1 through 4 illustrate a typical receiver 20 having locked therein a single individual test adapter 21. The test adapter 21 is positioned in FIG. 1 at the right hand side of the receiver 20, the receiver having an exposed left hand side portion capable of accommodating a second individual test adapter, when required.

Figure 3:
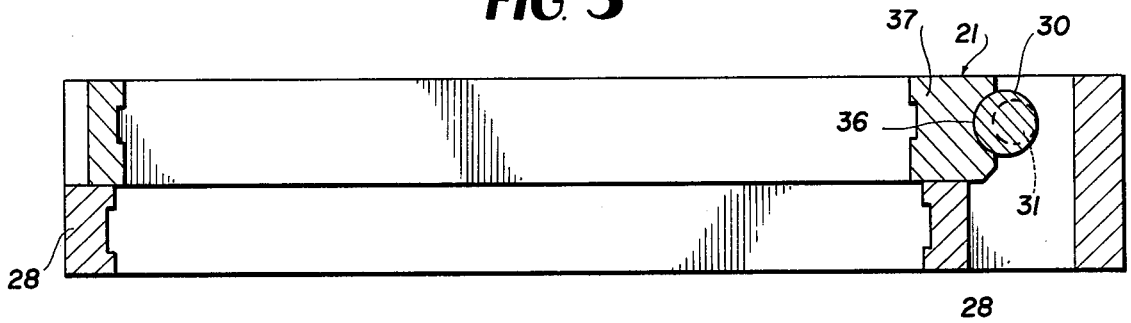
FIG. 3 is a like section taken on line 3—3 of FIG. 1.
Figure 4:
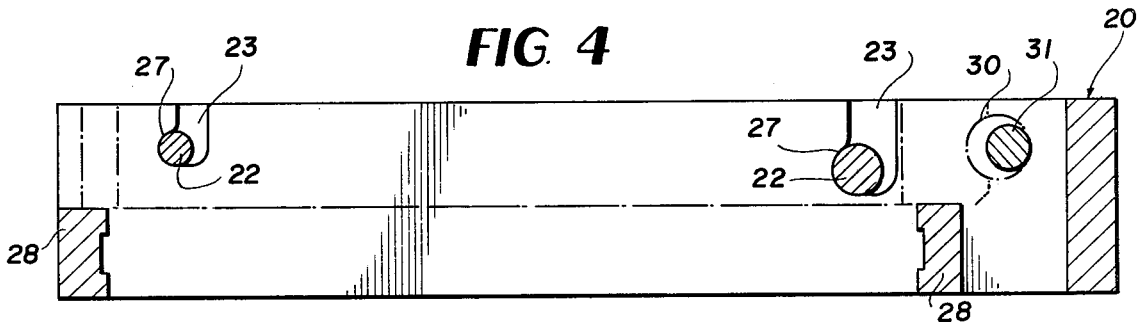
FIG. 4 is a like section taken on line 4—4 of FIG. 1.

The individual test adapter 21 has locator lugs 22 near its four corners for entry into pairs of J-slots 23 in the face of the receiver as defined by end and intermediate rails 24, 25 and 26. The J-slots 23 have lug positioning seats 27 at their inner ends to enable the lugs 22 to assume the locked positions on the receiver 20, as shown in FIGS. 4, when the individual test adapter positioning mechanism, yet to be described, is in a closed or locking position. The individual test adapter 21 rests solidly on transverse bars 28 of the receiver 20, as shown in FIGS. 3 and 4. The individual test adapter 21 preferably has a release handle 29.

The receiver 20 has a roll cam bar 30 near its end away from the handle 29, FIG. 1, and the roll cam bar 30 includes eccentric shaft extensions 31 journaled in openings provided in the rails 24, 25 and 26. It will be seen that the mechanism for positioning the individual test adapter 21 shown in FIGS. 6 through 15 of the drawings is drivingly coupled with the extension 31 journaled on the side rail 26 of the receiver 20. This positioning mechanism designated in its entirety by the numeral 32 constitutes the main subject matter of the invention used to accomplish the objectives noted in the introductory part of the specification.

The mechanism 32 is disposed within a recess 33 formed in the receiver side rail 26 at its leading end, the recess having a main flat mechanism locator surface 34 and a right angular end abutment surface 35, to be further described. It will be seen that the placement of the mechanism 32 compactly in the confines of the recess 33 enables the invention to lie substantially within the receiver frame margin without increasing the size of the equipment. As best shown in FIG. 3, the roll cam bar 30 engages in a concave recess or seat 36 provided in one frame member 37 of the individual test adapter 21. In some cases, a flat surface on the individual test adapter frame may be engaged by a complementally-shaped camming member.

The individual test adapter positioning mechanism 32 comprises a cam arm 38 having one face thereof lying against the locator surface 34. The roll cam bar shaft extension 31 is received through a journal opening 39, FIG. 13, in the side rail 26 and also within a registering opening 40 of the cam arm 38. The parts 31 and 38 are locked in properly assembled relationship by a locking pin 41. In the assembly, the set screw 41' is received by a screw-threaded opening in the cam arm 38 and acts on the locking pin 41 to secure the same. The cam arm 38 is relieved on opposite sides for a part of its length to form a reduced thickness end portion 42 which is spaced from the locator surface 34 sufficiently for a connecting link 43 to be engaged between the surface 34 and the end portion 42 of the cam arm 38. The connecting link 43 has a pair of end apertures 44 and 45 formed therethrough, and immediately below these apertures on the face of the link opposing the surface 34 of rail 26 is a pair of detent recesses 46, for a purpose to be described. The connecting link 43 is a floating element in the mechanism 32 which is not positively attached to the side rail 26 of the receiver but shifts over the flat locator surface 34 thereof during the operation of the mechanism.

A stud 47 has threaded engagement in a threaded opening 48 of the cam arm extension 42, or end portion, and a reduced diameter extension 49 of stud 47 is received in the aperture 44 of connecting link 43 and serves to pivotally connect one end of the link 43 with the cam arm 38. Following assembly, the threaded stud 47 and cam arm extension 42 are drilled to receive a stud locking roll pin 50.

Figure 14A:
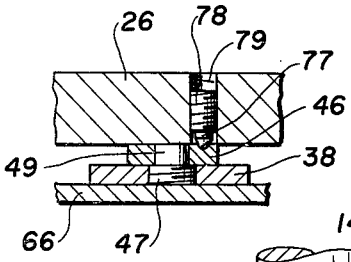
FIG. 14A is a fragmentary vertical section taken on line 14A—14A of FIG. 14.
Figure 14:
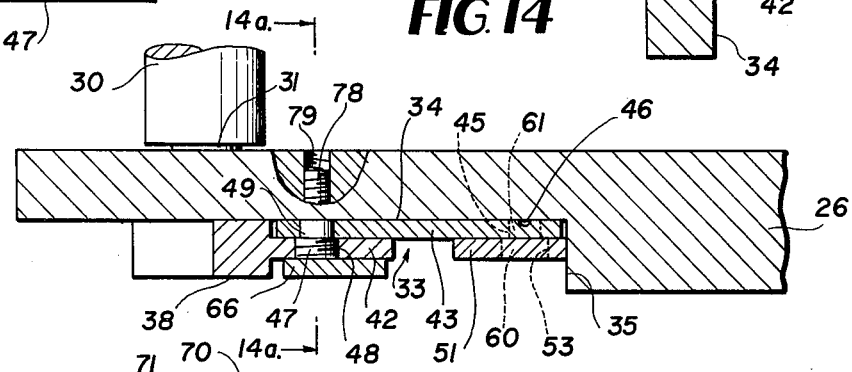
FIG. 14 is a similar section taken on line 14—14 of FIG. 8.
Figure 15:
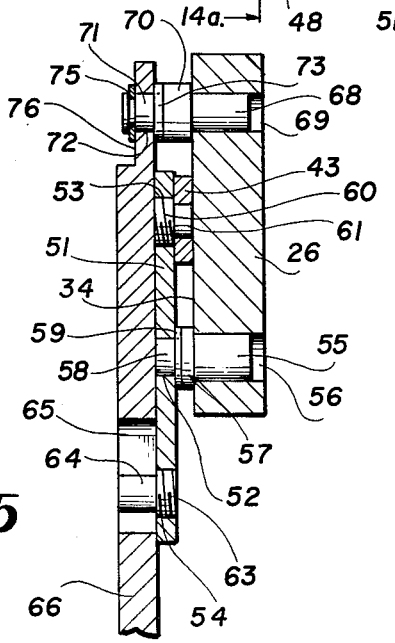
FIG. 15 is a similar section taken on line 15—15 of FIG. 10.

The mechanism further comprises a fulcrum arm 51 lying immediately outwardly of the connecting link 43, FIG. 14, and having a center pivot opening 52 and a pair of end screw-threaded openings 53 and 54. A large diameter stud 55 is pressed into an opening 56 of side rail 26 until a collar 57 on this stud solidly engages the locator surface 34. A reduced pin extension 58 on the stud 55 forms the fulcrum for the fulcrum arm 51 and is received in the pivot opening 52 thereof after first placing a plastic washer 59 on the pin extension 58. A threaded stud 60 is received in the threaded opening 53 of fulcrum arm 51 and has a reduced diameter pin extension 61 engaging in the opening 45 of connecting link 43 to form a pivotal connection between it and the fulcrum arm 51. Following assembly and drilling, the stud 60 is locked by a roll pin 62.

Another threaded stud 63 facing axially oppositely to the stud 60 is received in the threaded opening 54 of fulcrum arm 51. This stud has a reduced pin extension 64 thereon received cammingly in an elongated slot 65 of a manual level 66 used to operate the mechanism. After assembling and drilling, the threaded stud 63 is locked by a roll pin 67, FIG. 7. The interior side of the lever 66 lies on the outer face of fulcrum arm 51, FIGS. 10 and 15, and during operation of the mechanism, FIGS. 8 and 14, is adapted to move into overlapping relationship with the reduced thickness extension 42 of the cam arm 38. This arrangement contributes greatly to the compactness of the stacked mechanism linkage enabling it to lie within the recess 33.

A manual lever support and pivot pin 68 is pressed into another opening 69 of the side rail 26 up to a spacer collar 70 which abuts the outer face of the side rail. Outwardly of the spacer collar 70, a pivot pin extension 71 of reduced diameter projects from the collar and is engaged through a pivot opening 72 near the upper end of the manual lever 66 after placement of a plastic washer 73 on the extension 71. The spacer collar 70 and washer serve to elevate the lever 66 relative to the surface 34 so that it can overlie the fulcrum arm 51 as depicted in the drawings. The pin extension 71 has a groove 74 formed therein to receive a retaining E-ring 75 which ring lies immediately outwardly of an undercut surface 76 formed at the top of the manual lever 66.

It may now be seen that the single retaining E-ring 75 captures the several stacked elements of the mechanism between it and the opposing locator or retaining surface 34 of side rail 26, the overlying elements making up the linkage being self-retaining. This particular construction of the mechanism is one of the unique features of the invention.

In order to stabilize individual test adapter positioning mechanism 32 in its locking and release positions, a single spring-loaded Vlier plunger 77 has its threaded body 78 disposed in a threaded opening 79 of the receiver side rail 26, FIG. 14. The spring-loaded plunger 77 enters one of the detent recesses 46 in the opposing side of connecting link 43 as the latter is shifted during the operation of the mechanism to and from the locking and release positions. Additionally, the abutment surface 35 of side rail 26 forms a positive stop for the manual level 66 in the closed or locking position of the mechanism, and similarly, the abutment surface 35 acts as a positive stop for the fulcrum arm 51, FIGS. 8 and 14, when the mechanism is in the open or release position. Thus, the operator of the mechanism will not be able to override the detent system composed of the recesses 46 and Vlier plunger 77.

Figure 11:
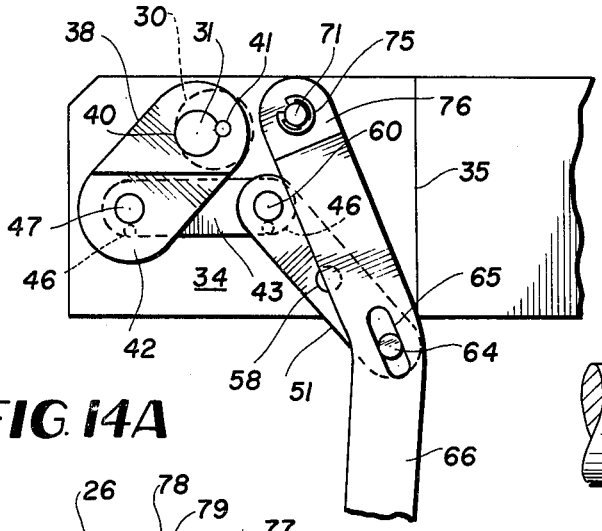
FIG. 11 is a similar view of the mechanism in a closed or test adapter locking position.
Figure 13:
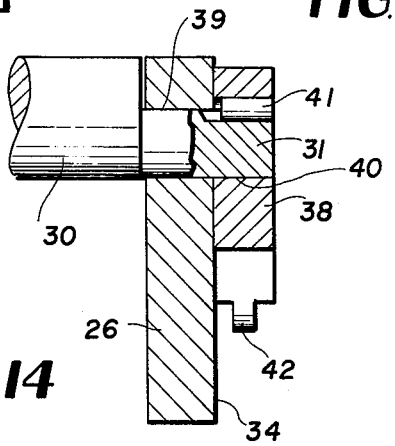
FIG. 13 is an enlarged fragmentary vertical section taken on line 13—13 of FIG. 8.

The directional arrows in FIG. 8 of the drawings indicate the paths of movement of the various elements in the mechanism when the manual lever 66 is swung from the release position of FIG. 8 to the closed or locking position of FIG. 11 and through the intermediate position of FIG. 10. During such operation, the manual lever 66 swings counterclockwise on the axis of pivot pin 71 or away from the operator 80 seated at the table 81 in FIG. 16. Simultaneously, fulcrum arm 51 turns counterclockwise on its pivot element 58 under influence of the camming operation of pin extension 64 in slot 65. Simultaneously, connecting link 43 is bodily shifted in the direction of the arrow in FIG. 8 and this produces clockwise movement of the cam arm 38 which is firmly attached to the shaft extension 31 of roll cam bar 30. The resulting eccentric rotation of the roll cam bar 30 while engaged in the concave seat 36 of individual test adapter 21 shifts the adapter with its multiple contacts into engaged current carrying relationship with the receiver 20 having the multiple yielding paddle contacts, as previously explained.

Figure 9:
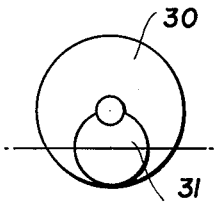
FIG. 9 is an enlarged end elevation of the roll cam bar in its position corresponding to FIG. 8.
Figure 12:
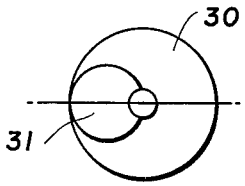
FIG. 12 is an end elevation of the roll cam bar in the position corresponding to FIG. 11.

In this engaging operation for the individual test adapter 21, a comparatively small angular travel of the manual lever 66 such as about 35 degrees or a total movement of the lever handle bar 82 of about 5½ inches will produce a full 90 degrees of rotation of the roll cam bar 30 from its release position shown in FIG. 9 to its closed or locking position shown in FIG. 12. Essentially, therefore, the simple mechanism is a low effort force multiplying mechanism between the handle bar 82 and roll cam bar 30 and also a motion increasing mechanism wherein a comparatively small oscillation of the lever 66 produces a significantly greater oscillation of the roll cam bar 30 to achieve the needs of the invention.

Figures 5, 7, 16:
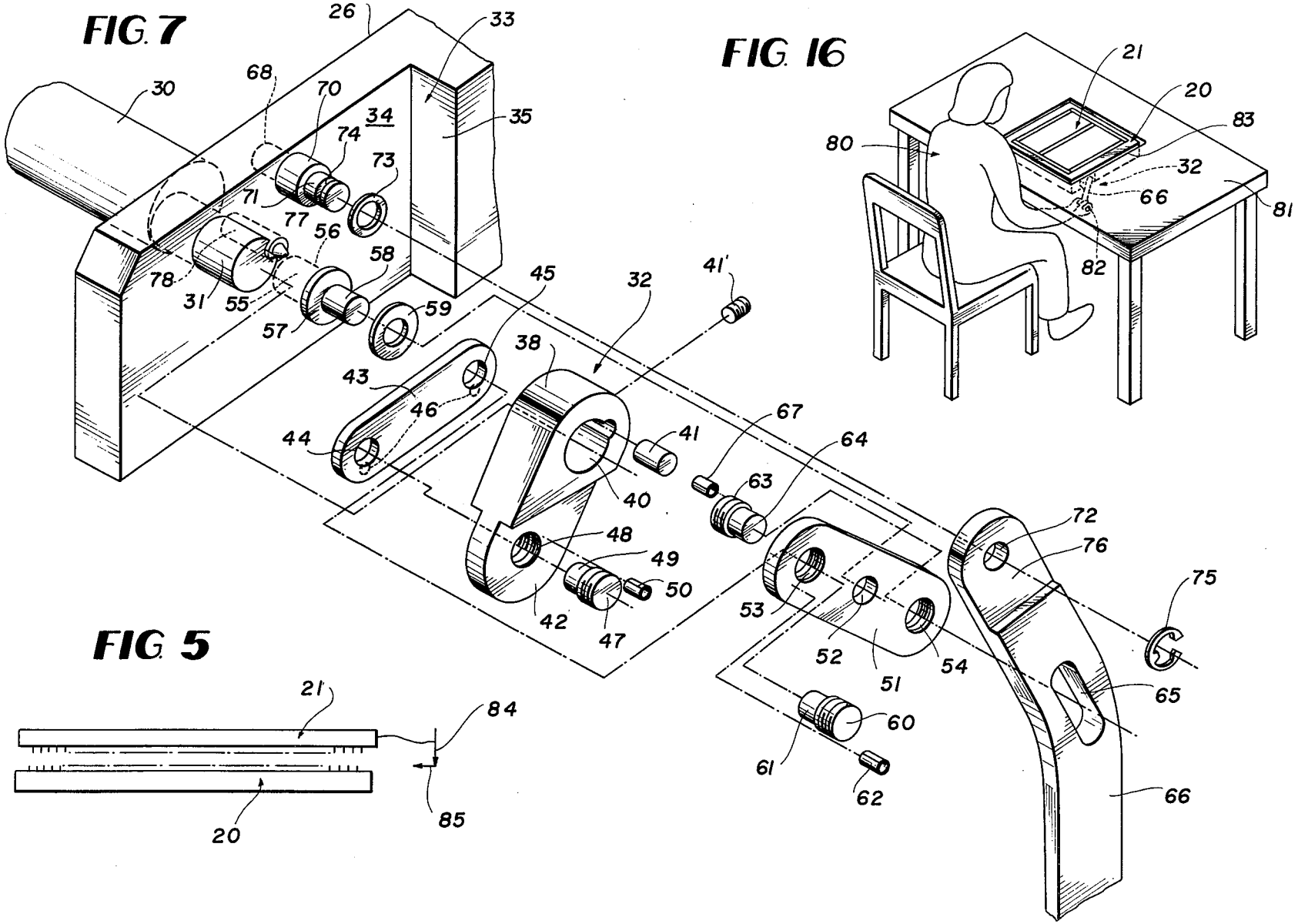
FIG. 5 is a schematic elevational view depicting movements of the individual test adapter relative to the receiver in the engaging process.
FIG. 7 is an exploded perspective view of the mechanism.
FIG. 16 is a partly schematic perspective view of the invention in use and showing the receiver in place upon a supporting table having a receiver well.

As shown in FIG. 16, the receiver 20 and individual test adapter are placed in a well of the table 81 and the manual lever extends below the well and table top near a knee of the seated operator 80 so that she may readily grasp the handle bar 82 and push it forwardly through a short stroke toward the locked position of FIG. 11 and pull it in the opposite direction to the release position of FIG. 8.

FIG. 5 merely shows schematically the initial placement of the individual test adapter 21 onto the receiver 20, as indicated by the directional arrow 84, followed by the shifting of the test adapter into contact engaging relationship with the receiver 20 in the direction of the arrow 85, under influence of the roll cam bar 30 and manual positioning mechanism 32.

When the mechanism is in the release position, the operator can utilize the handle 29 of the individual test adapter to separate it from the receiver.

Preferably, the handle bar or grip 82 is a knurled bar having a cross slot 86 to seat the lower extremity of the lever 66 which has a threaded opening 87 formed therein to receive an Allen head screw 88. The handle bar 82 has a through opening 89 intersecting the slot 86 and also receiving said screw. The arrangement is very secure and prevents the handle bar 82 from twisting or rotating.

The invention is characterized by simplicity of construction, compactness, ease and convenience of operation, and efficiency due to its direct action on the individual test adapter 21 through the roll cam bar 30 and associated driving mechanism 32. The many advantages of the invention should now be readily apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In an arrangement for positioning an individual test adapter in full operative engagement with a receiver for said test adapter and wherein the test adapter and receiver each has multiple contacts resisting such full operative engagement, and wherein the receiver has an eccentric cam means engaging with a surface formed in the individual test adapter to cause movement of the test adapter toward said full operative engagement responsive to rotation of the eccentric cam means in one direction, the combination with said eccentric cam means of a short stroke low effort force multiplying and motion amplifying mechanism on said receiver and coupled with said eccentric cam means and including a manual operating lever, said receiver having a side rail provided with a recess for said mechanism, said mechanism comprising plural connected elements including said lever disposed within the confines of said recess and being movable therein between locking and release positions of said mechanism, said recess having an end abutment surface which is engaged by said lever to limit movement of the lever in one direction and is engaged by another element of said mechanism to limit movement of the lever in the opposite direction, and said mechanism further comprising a fulcrum arm pivoted to said side rail in said recess and having a pivotal sliding connection with said lever, said lever being pivoted to said side rail within said recess, a floating connecting link within said recess and having a pivotal connection with said fulcrum arm, and a cam arm within said recess having a pivotal connection with said connecting link and being driven thereby and being directly secured to said eccentric cam means.

2. In an arrangement as defined in claim 1, said pivotal sliding connection of said fulcrum arm with said lever comprising a pin and slot connection.

3. In an arrangement as defined in claim 1, and a resilient detent means for said mechanism including cooperating parts on said mechanism and said side rail and being operable to stabilize the mechanism in said locking and release positions.

4. In an arrangement as defined in claim 1, and said eccentric cam means comprising a roll cam bar on said receiver having an eccentric end shaft extension journaled in an opening of said side rail adjacent to said side rail recess.

5. In an arrangement as defined in claim 4, and a single retainer ring for said lever on its pivotal connection with said side rail and serving to capture all of the elements of said mechanism between said ring and the opposing wall of said side rail recess.

6. In an arrangement as defined in claim 1, and said cam arm lying against a side wall of said recess and being relieved on opposite sides to form thereon an extension of reduced width spaced from said side wall, said connecting link also lying against said side wall and beneath said extension of reduced width, said fulcrum arm lying immediately outwardly of the connecting link and between such link and the interior side of said lever, spacer means on the pivot for the lever spacing the lever from said side wall sufficiently for the lever during its swinging movement to pass closely over the exterior side of said extension of reduced width, and a single retainer means for the lever on its pivot and serving to capture the entire mechanism between the single retainer means and said side wall in a compactly stacked operative manner.

* * * * *